United States Patent [19]

Izumi et al.

[11] 4,393,898

[45] Jul. 19, 1983

[54] FLUID OUTLET DEVICE AND A METHOD OF CONTROLLING FLUID FLOW THROUGH A NOZZLE

[75] Inventors: Masao Izumi, Fujisawa; Hiroshi Yoshida, Zama; Yukio Yoshikawa, Hiratsuka, all of Japan

[73] Assignee: Nissan Motor Co., Ltd., Yokohama, Japan

[21] Appl. No.: 219,637

[22] Filed: Dec. 24, 1980

[30] Foreign Application Priority Data

Dec. 28, 1979 [JP] Japan ..... 54-171762

[51] Int. Cl.[3] ..... B05B 1/14

[52] U.S. Cl. ..... 137/831; 137/624.11

[58] Field of Search ..... 364/509, 510; 239/1, 239/11, 99, 101, 461; 137/825, 829, 830, 831, 624.11

[56] References Cited

U.S. PATENT DOCUMENTS

| | | | |
|---|---|---|---|
| 3,357,441 | 12/1967 | Adams | 137/831 |
| 3,628,726 | 12/1971 | Johnson et al. | 239/101 |
| 3,771,567 | 11/1973 | Linden | 137/831 |
| 3,877,486 | 4/1975 | Merrell et al. | 137/831 |
| 3,942,559 | 3/1976 | Kranz et al. | 137/831 |
| 4,064,295 | 12/1977 | Singer | 239/11 |
| 4,326,452 | 4/1982 | Nawa et al. | 137/829 |

FOREIGN PATENT DOCUMENTS 1544111 4/1979 United Kingdom .

*Primary Examiner*—Gary Chin

*Attorney, Agent, or Firm*—Thompson, Birch, Gauthier & Samuels

[57] ABSTRACT

A fluid passing through a nozzle operative on the principle of wall effect of fluidic devices is variously deflected. A pair of control valves are provided at control fluid passages for supplying control jets into the throat portion of the nozzle in order to control the deflection of fluid flowing therethrough. A continuous straightforward flow is generated by simultaneous opening of said control valves.

5 Claims, 10 Drawing Figures

31
33
32
1
28
F
R
L
C

FLUID OUTLET DEVICE AND A METHOD OF CONTROLLING FLUID FLOW THROUGH A NOZZLE

BACKGROUND OF THE INVENTION

1. Field of the Invention

The present invention generally relates to a fluid outlet device having controllable directional flow capability, and also relates to a method for controlling a fluid outlet device of this sort. More specifically, the present invention relates to a fluid outlet device operating on the principle of the wall effect of fluidic devices, in which the direction of the fluid is controlled in accordance with the operation of a pair of valves incorporated therewithin.

2. Description of the Prior Art

Fluid outlet devices operating on the principle of the wall effect of fluidic devices such as an air outlet nozzle of an air conditioner or water sprinkling nozzle are available. However, in these available fluid outlet devices, continuous straightforward output flow is not obtained since the fluid flowing through the device is always deflected on either side of the device by the alternative opening of the valves. Consequently, there is a problem that the output fluid from the device does not spread into the front part of the fluid outlet device.

SUMMARY OF THE INVENTION

The invention is based of the recognition of the drawback of the fluid outlet device described herein above.

A primary object of the invention is therefore to provide an apparatus and a method for directing fluid flow through a nozzle acting on the principle of the fluidic device capable of continuously issuing a straightforward output flow from the outlet port of the nozzle.

According to the first aspect of the invention, a method of directing fluid flow through a nozzle having controllable directional flow capability, including first and second valves for selectively supplying first and second jets into a throat portion thereof, comprises: the first step of opening one of the first and second valves to deflect the fluid flow through the nozzle onto one of the side walls of an outlet port of the nozzle; and a second step of opening the other of the first and second valves to direct the fluid flow through the nozzle straightforwardly.

According to the second aspect of the invention, a method of directing fluid flow through a nozzle having controllable directional flow capability and including first and second valves for selectively supplying first and second jets onto a throat portion thereof, comprises in a sequence: a first step of opening the first valve to deflect the fluid flow through the nozzle onto the first side wall of an outlet of the nozzle; a second step of opening, after a first specified time has elapsed, the second valve to direct the fluid flow through the nozzle straightforwardly; a third step for closing, after a second specified time period has elapsed, the first valve to deflect the fluid flow through the nozzle onto the second side wall of the outlet of the nozzle; a fourth step for opening, after a third specified time period has elapsed, the first valve to redirect the fluid through the nozzle straightforwardly; and a fifth step for closing, after a fourth specified time period has elapsed, the second valve to deflect the fluid flow through the nozzle to the first side wall of the outlet of the nozzle.

According to the third aspect of the invention, a fluid outlet device for directing a fluid comprises: a nozzle including: an inlet port; an outlet port; a throat portion formed between the inlet port and the outlet port; first and second fluid control chambers positioned on either side of the throat portion; first and second control fluid passages communicating with respective fluid control chambers; first and second flappers for regulating the flow of fluid through respective control fluid pasages; and first and second electromagnets for controlling the operation of respective flappers, and a control circuit including: first and second driving transistors for actuating respective electromagnets; a control signal generator for supplying timed alternating square wave pulses to respective driving transistors; and first and second delay means respectively connected to said first and second driving transistors for retarding respective turn off timings thereof.

BRIEF DESCRIPTION OF THE DRAWINGS

The features and advantages of the method for directing a fluid flow through a nozzle and a fluid outlet device according to the present invention will be more clearly appreciated from the following description taken in conjunction with the accompanying drawings in which.

DESCRIPTION OF THE PREFERRED EMBODIMENT

Figure 1:
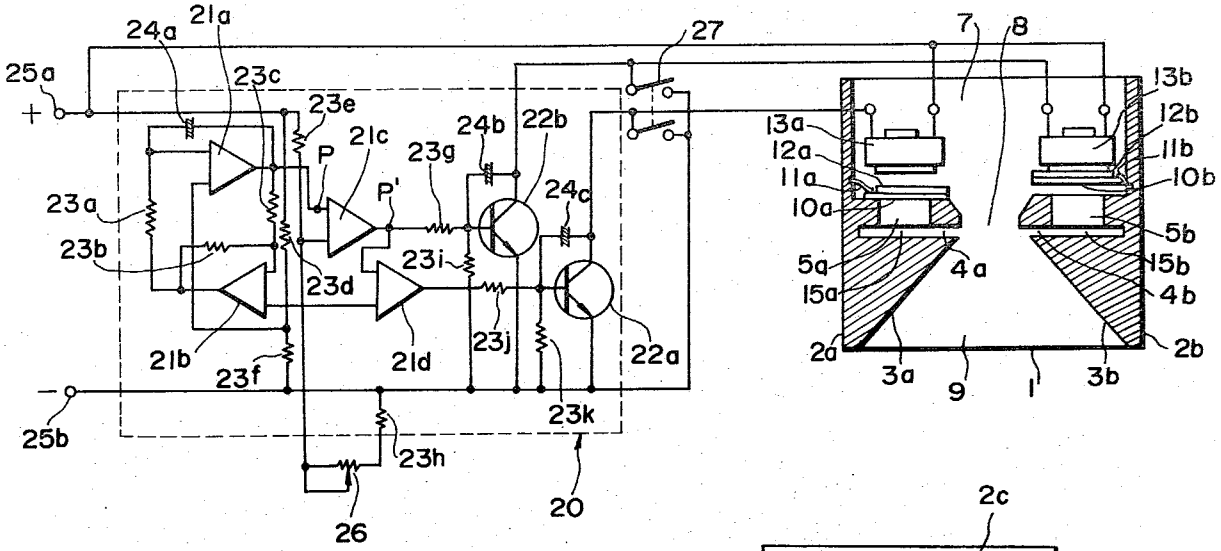
FIG. 1 is a circuit diagram of the control circuit of the electromagnets according to the present invention including a sectional view of the nozzle.
Figure 2:
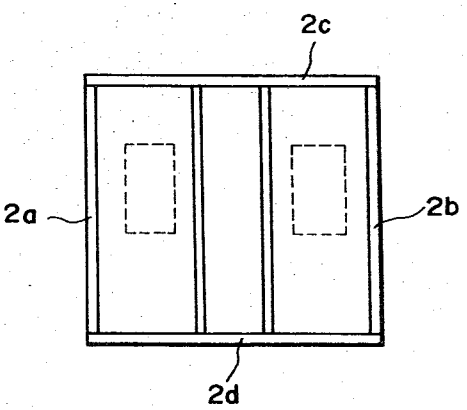
FIG. 2 is a front view of the nozzle according to the present invention.

Turning to the drawings, and more specifically to FIG. 1 and FIG. 2, the nozzle configuration of the present invention is shown generally illustrated by the numeral 1. This nozzle 1 comprises a closure formed by upper and lower wall plates **2*c* and 2*d* facing each other, and by right and left wall plates 2*a* and 2*b* also facing each other. The closure defines therein an inlet port 7, outlet port 9, and a throat portion 8 therebetween. The outlet port 9 widening from the throat portion 8 is defined by the upper and lower wall plates and each side wall 3*a* and 3*b*. Thus, a passage comprising the inlet port 7, throat portion 8 and outlet port 9 is defined within nozzle 1. In addition, a pair of control nozzles 4*a*, 4*b* are positioned respectively at either side of the throat portion 8. Each control nozzle 4*a*, 4*b* respectively communicates with a control chamber 15*a*, 15*b*, and further with a control fluid passage 5*a*, 5*b*, which fluid passages communicate with the inlet port 7 at their respective upstream ends. Electrically controlled valves comprising components numbered 10*a* to 13*a* and 10*b* to 13*b* are respectively disposed at the upstream ends of the control fluid passages. Each electrically controlled valve 10*a* to 13*a* or 10*b* to 13*b* comprises, a flapper 10*a* or 10*b* movably disposed at the upstream end of the control fluid passage 5*a* or 5*b*, and an armature iron plate 12*a* or 12*b* fixed to the flapper 10*a* or 10*b*, a leaf spring 11*a* or 11*b* which forces the flapper 10*a* or 10*b* onto an opening formed at the end of the control fluid passage 5*a* or 5*b*, and an electromagnet 13*a* or 13*b* disposed to face the armature iron plate 12*a* or 12*b*, maintaining a predetermined gap therebetween. These valves 10***a* to 13*a*, 10*b* to 13*b* are controlled by driving currents from a control circuit described hereinafter. In addition, the inlet port 7 of the nozzle 1 is supplied with a pressurized fluid from, for example, an air conditioner system. Thus, the fluid flowing through the nozzle exits the outlet port 9, and the direction of the output flow is controlled in accordance with the operation of the electrically controlled valves 10*a* to 13*a* and 10*b* to 13*b*.

The operation of the nozzle will be explained hereinafter. When the electromagnet 13*a* or 13*b* is energized, as is the electromagnet 13*b* shown in FIG. 1, it attracts the respective armature iron plate 12*a* or 12*b* and the flapper 10*a* or 10*b* fixed thereto against the resilient force of the leaf spring 11*a* or 11*b*. Thus, the flapper 10*a* or 10*b* moves toward a position away from the opening of the control fluid passage 5*a* or 5*b*. As the result of the movement of the flapper 10*a* or 10*b*, the control fluid passage 5*a* or 5*b* communicates with the inlet port 7, and the pressurized fluid within the inlet port 7 flows into the control chamber 15*a* or 15*b* through the control fluid passage 5*a* or 5*b*. The fluid within the control chamber 15*a* or 15*b* then exits the control nozzle 4*a* or 4*b* into the throat portion 8 of the nozzle 1 since the pressure within the control chamber 15*a* or 15*b* is raised by the fluid flowing through the control fluid passage 5*a* or 5*b*. Thus the control jet from the control nozzle 4*a*, 4*b* is produced.

On the other hand, when the electromagnet 13*a* or 13*b* is de-energized, as is the electromagnet 13*a* shown in FIG. 1, the armature iron plate 12*a* or 12*b* and the flapper 10*a* or 10*b* are pressed upon the opening of control fluid passage 5*a* or 5*b* in accordance with the resilient force of the leaf spring 11*a* or 11*b*. Consequently, the control fluid passage 5*a* or 5*b* is isolated from the inlet port 7. Thus, the pressure within the control chamber 15*a*, 15*b* is maintained at a negative value as compared with the pressure within the throat portion 8. Needless to say, a control jet is not produced at the control nozzle 4*a* or 4*b* in this case.

As is readily appreciated from the foregoing, when the electromagnet 13*b* is solely energized as shown in FIG. 1, only a control jet from the control nozzle 4*b* occurs. In such an operative condition of the nozzle, the fluid flowing therethrough is deflected at the throat portion 8, by the control jet from the control nozzle 4*b*, to the right side (as viewed from inlet port 7 towards outlet port 9) of the throat portion 8 in which the control nozzle 4*a* is located, due to the negative pressure within the control chamber 15*a* on the side of the de-energized electromagnet 13*a*. Once the fluid through the throat portion 8 is deflected, the flow is locked onto the side wall 3*a* of the outlet port 9, then exits the outlet port 9 and is directed to the rightward side of the nozzle 1.

Similarly, if the electromagnet 13*a* is solely energized, the fluid flowing through the nozzle is locked onto the side wall 3*b*, and is directed to the leftward side of the nozzle 1. Thus, the deflected output flow exits the nozzle 1 by the energization of one of the electromagnets 13*a* or 13*b*.

When both of the electromagnets 13*a* and 13*b* are energized, the fluid within the control chambers 15*a* and 15*b* exits the control nozzles 4*a* and 4*b* in a manner similar to that described above. In this case, the fluid flowing through the throat portion 8 is applied with control jets from the control nozzles 4*a* and 4*b* positioned on either side of the throat portion, and therefore exits the outlet port 9 straightforwardly.

Referring to FIG. 1, the construction of the control circuit 20 will be explained. This control circuit 20 comprises: operational amplifiers 21*a* to 21*d*; driving transistors 22*a* and 22*b*; a variable resistor 26 connected to an input of the operational amplifier 21*c*, resistors 23*a* to 23*k* connected to the operational amplifiers 21*a* to 21*d*, the transistors 22*a* and 22*b*, and to the variable resistor 26; condenser 24*a* connected to the operational amplifier 21*a* and condensers 24*b* and 24*e* inserted between the base and the collector of respective transistors 22*b* and 22*a*; switch 27; and terminals 25*a* and 25*b* for a power supply for providing a positive and negative power voltage.

The operational amplifiers 21*a* to 21*d* form a square wave pulse generator, and the driving transistors 22*a* and 22*b* are controlled in accordance with the timed alternating square wave pulses generated by these operative amplifiers. The duty factors of each square wave pulse is varied by the adjustment of the variable resistor 26.

The operation of this control circuit 20 is then explained. When the electric power is supplied to the terminals 25*a* and 25*b* of the control circuit 20, the operational amplifier 21*a* along with the operational amplifier 21*b* produces a constant frequency triangular wave pulse at its output terminal. This triangular wave pulse of the operational amplifier 21*a* is applied to the inverting input P of the operational amplifier 21*c* acting as a comparator, and is compared with a reference voltage level applied to the noninverting input thereof. The noninverting input of the operational amplifier 21*c* is connected to a junction between the resistor 23*e* and the variable resistor 26. The resistor 23*e* is connected to the "+" terminal 25*a* and the variable resistor 26 is connected to the "−" terminal 25*b* through a resistor 23*h*. Therefore, the reference voltage is varied by the variable resistor 26 within a predetermined range. When the voltage level of the triangular wave pulse exceeds the reference voltage level, the operational amplifier 21*c* produces a high level output signal at its output terminal P'. Thus, a square wave pulse signal is produced by the operational amplifier 21*c*, and the duty factor of this square wave pulse is varied by the manual operation of the variable resistor 26.

The operational amplifier 21*d* is used for inverting the square wave pulse produced by the operational amplifier 21*c*, and hence, the inverting input terminal thereof is connected to the output terminal P' of the operational amplifier 21*c*. Thus, timed alternating square wave pulses, are produced by these operational amplifiers 21*a* to 21*d*, and are respectively applied to the base of the driving transistors 22*a* and 22*b* through respective resistors 23*j* and 23*g* for controlling these transistors.

The electromagnets 13*a* and 13*b* are interposed between the terminal 25*a* and the collector of respective driving transistors 22*a* and 22*b*. The driving current flowing through the collector of the driving transistor 22*a* or 22*b* is controlled in accordance with the current flowing through the base thereof. Thus, the driving currents for respective electromagnets 13*a* and 13*b* are initiated at each leading edge of the square wave pulses.

In the present invention, the square wave pulse at the base of transistor 22*b* turns it on. With the transistor 22*b* thus conducting, its base and collector potentials are equal. Therefore, the condenser 24*b* discharges during this square wave pulse time period that the transistor 22*b* is conducting. During this time also, of course, the electromagnet 13*b* is energized. At the end of the square wave pulse the transistor turns off, resulting in a voltage potential difference across its base and collector. The condenser 24*b* begins to charge at this trailing edge of the square wave pulse, thus maintaining the driving current for the electromagnet 13*b* for a specified time duration following this square wave pulse trailing edge while the condenser 24*b* is charging. Thus, the electromagnet 13*a* or 13*b* is supplied with the driving current as the respective condenser charges and the flapper 10*a* or 10*b* is kept open until the resilient force applied thereto exceeds the attracting force of the electromagnet 13*a* or 13*b*. By the operation of the control circuit 20, the electromagnets 13*a* and 13*b* are alternatively supplied with a driving current. Additionally, and during the period described above in which either condenser is charging, both electromagnets 13*a* and 13*b* are energized simultaneously, and the flow from the nozzle 1 is generally straightforward. Furthermore, the direction of the fluid flow from the nozzle 1 is automatically oscillated in accordance with the square wave pulses. In addition, the switch 27 is incorporated in the control circuit for supplying a continuous driving current to both electromagnets 13*a* and 13*b*.

Figures 3A, 3B, 3C, 3D:
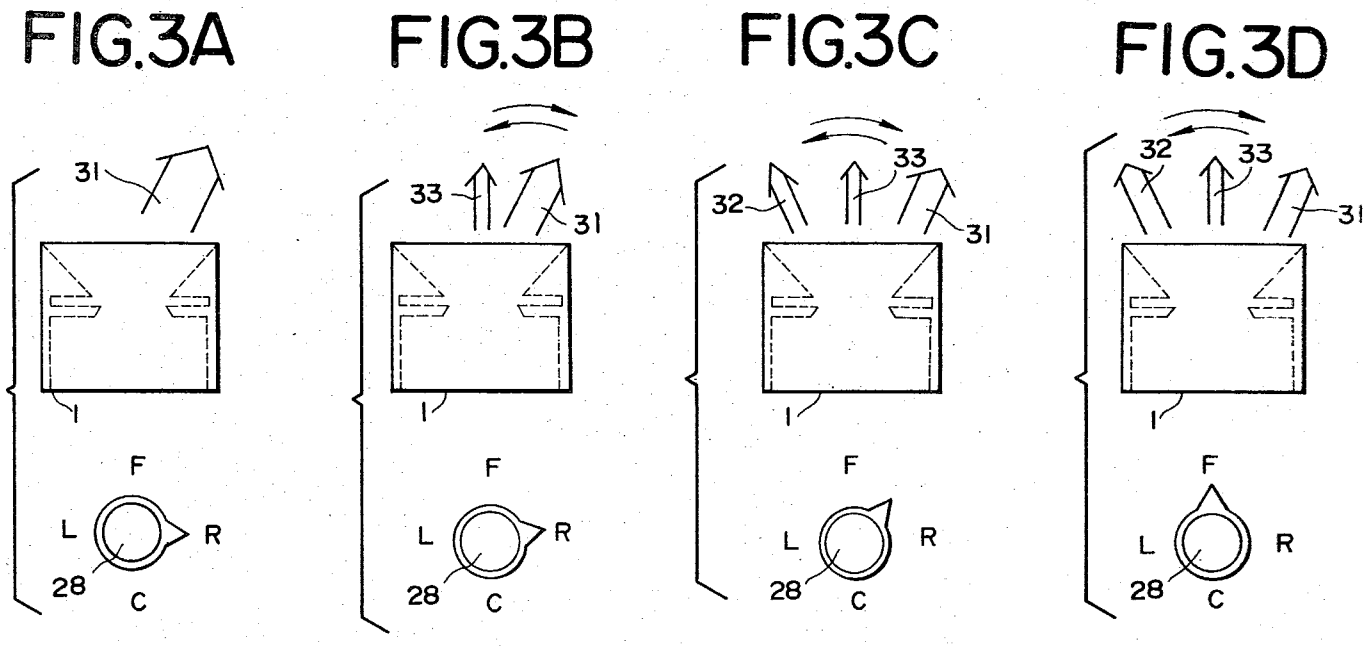
FIG. 3A to FIG. 3H are the drawings showing the relationship of the operational mode of the control circuit and the direction of the fluid issued from the nozzle according to the present invention.

Referring to FIG. 3A to FIG. 3H, the various operational modes of the fluid outlet device according to the present invention will be explained. In the case of the present invention, a variable output flow direction is obtained by the combination of the operations of the electromagnet 13*a* and 13*b*. The drive timings of each electromagnets 13*a* and 13*b* are determined by the manual operation of a knob 28 which is connected to the variable resistor 26 and the switch 27. When the knob 28 is positioned at the F position as shown in FIG. 3D, the square wave pulse has a duty factor of 50%. In other words, the pulse width is equal to the pulse interval. In this state, when the electromagnet 13*b* is energized and the electromagnet 13*a* is de-energized, rightward flow 31 exits the nozzle. After a time period determined by the control circuit 20 has elapsed, the electromagnet 13*a* is also energized by the driving transistor 22*a*, while the electromagnet 13*b* remains energized for a predetermined period as explained above. Thus, the output flow is straightforward, as indicated by the reference numeral 33 in FIG. 3*d* during this period. When the electromagnet 13*b* is de-energized, the direction of the output flow is then deflected to the left, as is shown by the reference numeral 32 in FIG. 3D. When the electromagnet 13*b* is subsequently energized, the direction of the output flow is then deflected rightwardly and straightforwardly, in a similar manner as described above. In this way, an oscillating output flow exits the nozzle 1 in accordance with the square wave pulses produced by the control circuit 20.

The rightward turning of the knob 28 lengthen the duration of the rightward deflected flow 31 and shortens the duration of the leftward deflected flow 32, while the duration of the straightforward flow 33 is maintained constant because it is determined by the time for charging the condensers 24*b* and 24*c*. The relation between the position of the knob 28 and the direction of the output flow is depicted in FIG. 3C.

By the further turning of the knob 28, the leftward deflected flow 32 is extinguished and the the direction of the flow is restricted to the combination of the rightward deflected flow 31 and the straightforward flow 33 as shown in FIG. 3B, and still further turning of the knob 28 produces the rightward fixed flow 31 as shown in FIG. 3A.

Figure 3E:
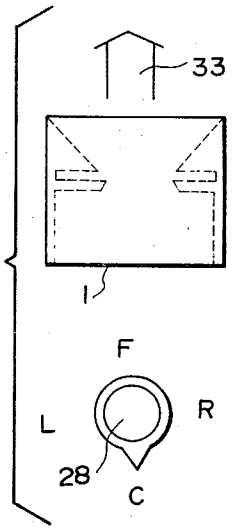
Figure 3F:
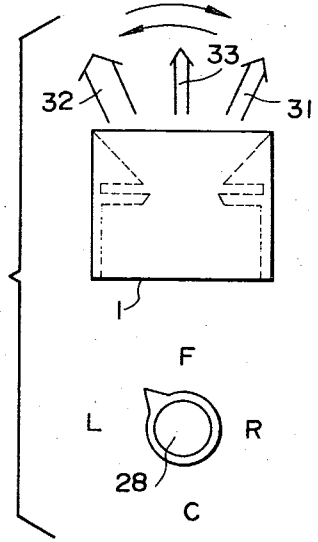
Figure 3G:
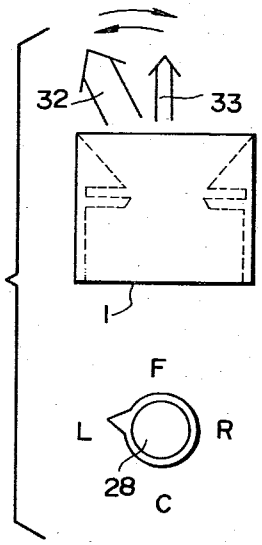
Figure 3H:
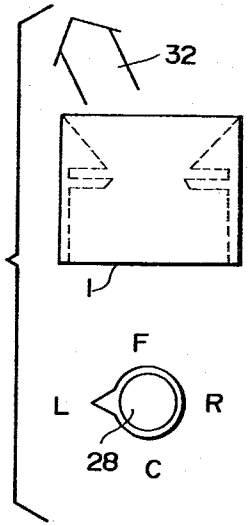

On the other hand, by turning the knob 28 to the left, the duration of the leftward deflected flow 32 is lengthened as shown in FIG. 3F in the same manner as described above, and by further turning the knob 28 to the left, the direction of the flow is restricted to the combination of the leftward flow 32 and the straightforward flow 33, as shown in FIG. 3G, and still further turning of the knob 28 produces the leftward fixed flow 32 as shown in FIG. 3H. In addition, if the fixed straightforward flow is needed, the knob 28 is positioned at the point C as shown in FIG. 3E, which closes the switch 27, bypassing the oscillating circuit 20, and connects both electromagnets directly across the "+" and "−" terminals for a steady-state "ON" condition.

It will be appreciated from the foregoing, in the fluid outlet device of the present invention, continuous straightforward flow and various control modes of the direction of the output flow from the nozzle 1 are obtained by the operation of the control circuit 20.

What is claimed is:

1. A fluid outlet device for directing a fluid comprising:

(a) a nozzle including the following portion;
  (1) an inlet port;
  (2) an outlet port;
  (3) a throat portion formed between said inlet port and outlet ports;
  (4) first and second fluid control chambers positioned on either side of said throat;
  (5) first and second control fluid passages communicating with respective fluid control chambers;
  (6) first and second flappers for regulating the flow of fluid through respective control fluid passages; and
  (7) first and second electromagnets for controlling the operation of respective flappers, and (b) a control circuit comprising:
  (1) first and second switching means for actuating respective electromagnets;
  (2) a control signal generator for supplying timed alternating square wave pulses to respective switching means; and
  (3) first and second delay means respectively connected to said first and second switching means for retarding respective turn off timings thereof.

2. A fluid outlet device as set forth in claim 1, wherein the duty factors of said timed alternating square wave pulses are variable.

3. A fluid outlet device as set forth in claim 1, wherein said delay means comprises first and second capacitors respectively connected between the base and the collector of said first and second switching means.

4. A fluid outlet device as set forth in claim 1, further comprising a switch incorporated in the control circuit for supplying driving currents to either first and second electromagnets.

5. A fluid outlet device as set forth in claim 1 wherein said switching means comprise driving transistors.

* * * * *